United States Patent [19]

Bosshard et al.

[11] Patent Number: 4,667,566

[45] Date of Patent: May 26, 1987

[54] COUNTERCOIL AND RECOIL DAMPERS FOR AUTOMATIC FIREARMS

[75] Inventors: Werner Bosshard; Werner Stauffacher, both of Zurich, Switzerland

[73] Assignee: Werkzeugmaschinenfabrik Oerlikon-Bührle AG, Zurich, Switzerland

[21] Appl. No.: 828,053

[22] Filed: Feb. 10, 1986

[30] Foreign Application Priority Data

Feb. 21, 1985 [CH] Switzerland ..... 00802/85

[51] Int. Cl.[4] ..... F41F 19/06

[52] U.S. Cl. ..... 89/44.01; 89/177; 89/198

[58] Field of Search ..... 89/44.01, 44.02, 42.01, 89/4.05, 4.1, 4.5, 4.2, 177, 162, 198

[56] References Cited

U.S. PATENT DOCUMENTS

| | | | |
|---|---|---|---|
| 834,753 | 10/1906 | Reifgraber | 89/177 |
| 1,096,324 | 5/1914 | Stamm | 89/177 |
| 2,249,310 | 7/1941 | Braun et al. | 89/44.01 |
| 2,788,714 | 4/1957 | Browning | 89/177 |
| 3,425,318 | 2/1969 | Whitehill | 89/44.02 |

FOREIGN PATENT DOCUMENTS

| | | | |
|---|---|---|---|
| 684701 | 12/1939 | Fed. Rep. of Germany . | |
| 737789 | 7/1943 | Fed. Rep. of Germany | 89/44.01 |
| 786865 | 9/1935 | France . | |
| 2228213 | 11/1974 | France . | |
| 829974 | 3/1960 | United Kingdom . | |
| 1008430 | 10/1965 | United Kingdom | 89/44.01 |
| 1226918 | 3/1971 | United Kingdom . | |

*Primary Examiner*—Stephen C. Bentley
*Assistant Examiner*—S. Johnson
*Attorney, Agent, or Firm*—Marmorek, Guttman & Rubenstein

[57] ABSTRACT

A countercoil and recoil damper for an automatic firearm which ensures floating support of the weapon during automatic bursts of fire is disclosed. To achieve this, the damper provides annular spring packs (32–35) and a precompressed spring (24), colinear with the other annular spring packs. The precompressed spring is a coil spring which is compressed during countercoil and is released during recoil in order to increase the hysteresis of the annular spring packs (32–35).

18 Claims, 2 Drawing Figures

COUNTERCOIL AND RECOIL DAMPERS FOR AUTOMATIC FIREARMS

BACKGROUND OF THE INVENTION

This invention relates a countercoil and recoil damper for an automatic firearm having a gun mount, a weapon housing mounted on the gun mount in such manner that it can slide backward and forward from a starting position, at least two packs of annular springs arranged in a row for damping the recoil energy after the firearm has been fired, and one annular spring pack for damping the countercoil energy. The characteristics graph of the annular spring packs is steeper during compression than during release.

Many devices of a similar type are known. The most important ones are as follows: In Swiss Pat. No. 497,678, there is described a device for the damping of countercoil and recoil in an automatic firearm. Mounted in a gun mount, the weapon housing slides backward and forward from a starting position, and is provided with two annular spring packs arranged in a row, the first annular spring pack being designed to absorb the countercoil energy, and the first and second annular spring packs arranged in a series being designed to absorb the recoil energy together. The characteristics graph of these annular spring packs is steeper during compression than during release.

Known devices, such as that described in Swiss Pat. No. 497,678, do not ensure a floating support of the weapon, as the exclusive use of annular spring packs either causes excessive hysteresis dispersion, when the angle of the annular springs is small, or too little hysteresis when the angle of the annular springs is too wide.

To ensure floating support of a firearm, known hydraulic brakes are used. Swiss Pat. No. 427,576 describes an automatic firearm with a locking housing supported on a mount, capable of backward movement, having a damping device positioned between the housing and the mount. This damping device is provided with a hydraulic brake that acts against a rest position during forward movement or countercoil of the firearm. The brake is further equiped with a buffer element which catches the weapon's countercoil in an elastic manner. The buffer element and the hydraulic brake are arranged in series. The buffer element dampens the shock which occurs when the closure impacts upon the closurre housing when the weapon moves forward on the weapon mount.

This known device has the disadvantage of every buffer element, i.e., it is dependent upon the temperature of the liquid, so that consistent operation is not possible at all temperatures.

SUMMARY OF THE INVENTION

The instant invention has as its objective to accomplish the following:

1. The weapon is to be supported floatingly and reliably after a burst of fire.

2. At the same time, the transfer of great forces from the movably supported weapon to the fixed gun mount, in case of weapon malfunction, is to be avoided.

The inventive device accomplishes this by means of a third, pretensioned spring provided in addition to the aforementioned two annular spring packs that are arranged in a row, said third spring being compressed during forward movement of the weapon and being released during weapon recoil, the pretensioning being adjusted so that the spring forces act in opposite directions upon the weapon throughout weapon recoil.

Preferably, the third spring bears upon a flange of the gun mount at its forward end, and against a shoulder of the weapon housing at its rear end, during recoil as well as during countercoil. Preferably also, the characteristics graph of the two aligned annular spring packs increases progressively.

The device has the advantage of ensuring good, floating weapon support during automatic firing bursts and of avoiding severe impact of the weapon upon the gun mount in case of malfunction.

BRIEF DESCRIPTION OF THE DRAWINGS

A preferred example of the inventive countercoil and recoil damper is described in detail hereinafter, with reference being made to the enclosed drawings. These show.

DETAILED DESCRIPTION OF A PREFERRED EMBODIMENT

Figure 1:
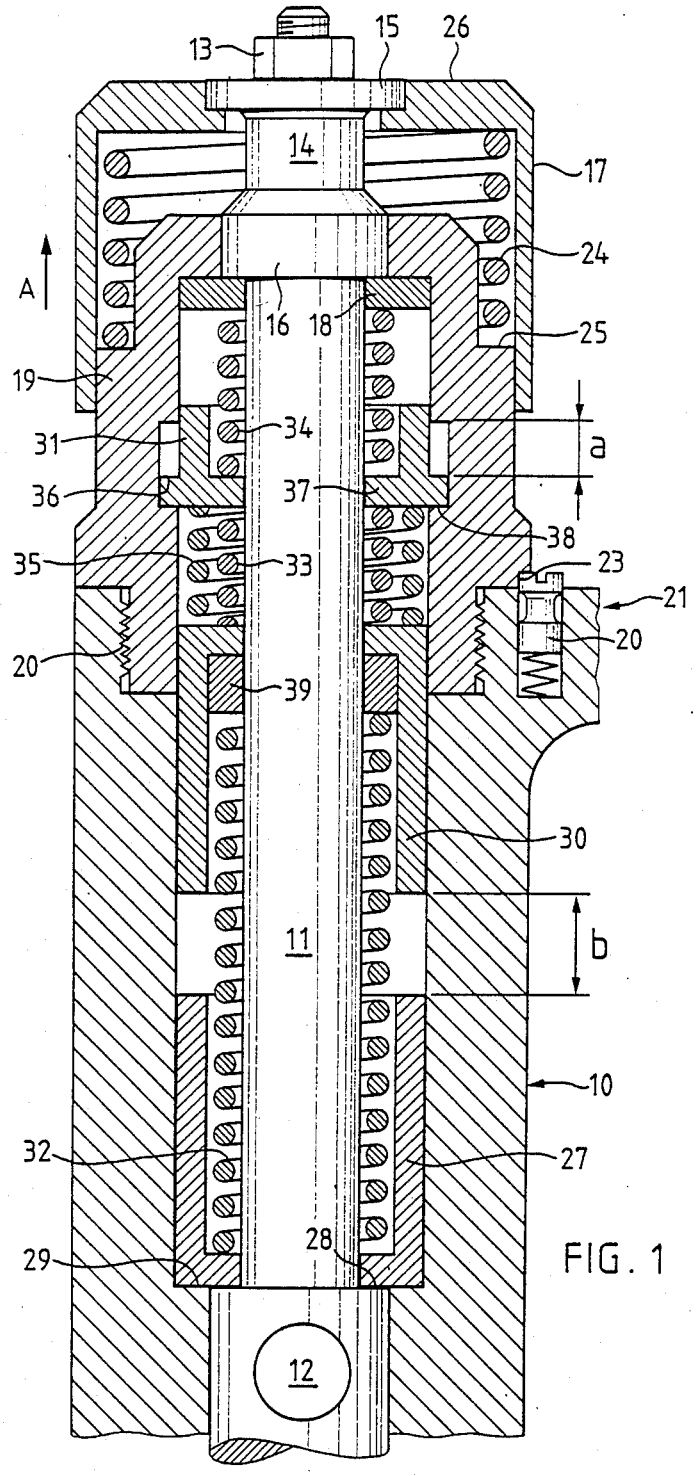
FIG. 1 A longitudinal section through the entire countercoil and recoil damper.

Referring to FIG. 1, a firearm having a movable weapon housing and a fixed gun mount is illustrated. Of the entire weapon, only a portion of movable weapon housing 10 is shown.

Also shown is a rod 11 which is immovably attached by means of a bolt 12 to a gun mount (not shown).

Referring now to the parts attached to the fixed gun mount, a spacer 14 is shown attached to the upper end of rod 11 by means of a nut 13. Spacer 14 has two flanges 15 and 16. A sleeve 17 bears upon the upper flange 15 and a sliding ring 18 bears upon the lower flange 16, with sleeve 17, as well as ring 18 bearing upon flanges 15 or 16 of spacer 14 in the direction of illustrated arrow A, i.e., in the weapon's direction of fire.

Referring now to the parts attached to the movable weapon housing, a second sleeve 19 bears in the direction opposite to A upon ring 18, said sleeve 19 being attached to weapon housing 10 by means of threads 20. This second sleeve 19 is slidingly fitted inside the first sleeve 17. To prevent rotation of the second sleeve 19 within the weapon housing 10, a safety device 21 is provided. This safety 21 comprises a spring loaded pin 20 in a bore of weapon housing 10, said pin 20 extending into notches 23 provided in the second sleeve 19, thus securing sleeve 19 against accidental rotation relative to weapon housing 10. The first sleeve 17 contains a coil spring 24 bearing with its forward end upon a flange 26 of the first sleeve 17 and bearing with its rear end upon a second shoulder 25 of the second sleeve 19. This coil spring 24 tends to push the weapon backward from the direction of fire, i.e., in a direction opposite to arrow A.

In a manner analogous to ring 18, a sleeve 27 bears upon an extended shoulder 28 of fixed rod 11 on the one hand, and on an internal shoulder 29 of the movable weapon housing 10 on the other hand. An additional two sleeves, 30 and 31, are able to slide on rod 11. An annular spring pack 32 is located between the two sleeves 27 and 30. A second annular spring pack 33 is located between sleeves 30 and 31, and a third annular spring pack 34 is located between sleeve 31 and ring 18. Finally, a fourth annular spring pack 35 is located between the two sleeves 30 and 31, said fourth annular spring pack 35 being parallel with the second annular spring pack 33.

The first annular spring pack 32 can be compressed only until the upper end of sleeve 27 abuts against the lower end of sleeve 30. In the same manner, the third annular spring pack 34 can be compressed only until sleeve 19 abuts against one of the shoulders 36 of sleeve 31. The two annular spring packs 33 and 35 which are arranged parallel to each other can be compressed completely until the individual rings of the annular spring packs 33 and 35 contact each other, unless a stop (not shown) is provided to prevent this.

Sleeve 31 is provided with a flange 37 by which it bears upon a shoulder 38 of sleeve 19 of weapon housing 10. Annular spring packs 32 through 35 tend to push the weapon forward, in the direction of arrow A.

The operation of the above-described countercoil and recoil brake is as follows:

When a shot is fired, the recoil causes the weapon to move back. Thereby, weapon housing 10 also moves from its shown position in a direction opposite to arrow A. Sleeve 19, attached to housing 10, is displaced in relation to rod 11 also in a direction opposite to arrow A. This displacement of sleeve 19 in relation to rod 11 also displaces ring 18, and annular spring pack 34 is compressed. At the same time, sleeve 19 moves closer to shoulder 36 of sleeve 31. Also at the same time, spring 24 is released, since sleeve 17 does not move, so that the distance between shoulder 25 of sleeve 19 and flange 26 of sleeve 17 increases. Spring 24, precompressed in the weapon's starting position, is thus released. Since the two sleeves 31 and 30 are also capable of sliding along rod 11, the compression of annular spring pack 34 causes sleeve 31 to be displaced, and annular spring packs 33 and 35 are compressed. Correspondingly, the compression of annular spring packs 33, 35 also causes displacement of sleeve 30 and compression of annular spring pack 32. Since sleeve 27 bears upon shoulder 28 of rod 11 it cannot move during weapon recoil. Thus, when annular spring pack 34 is compressed, sleeve 19 moves toward shoulder 36 of sleeve 31 and will eventually abut against it. Once the two sleeves 19 and 31 abut, annular spring pack 34 cannot be compressed any further.

Figure 2:
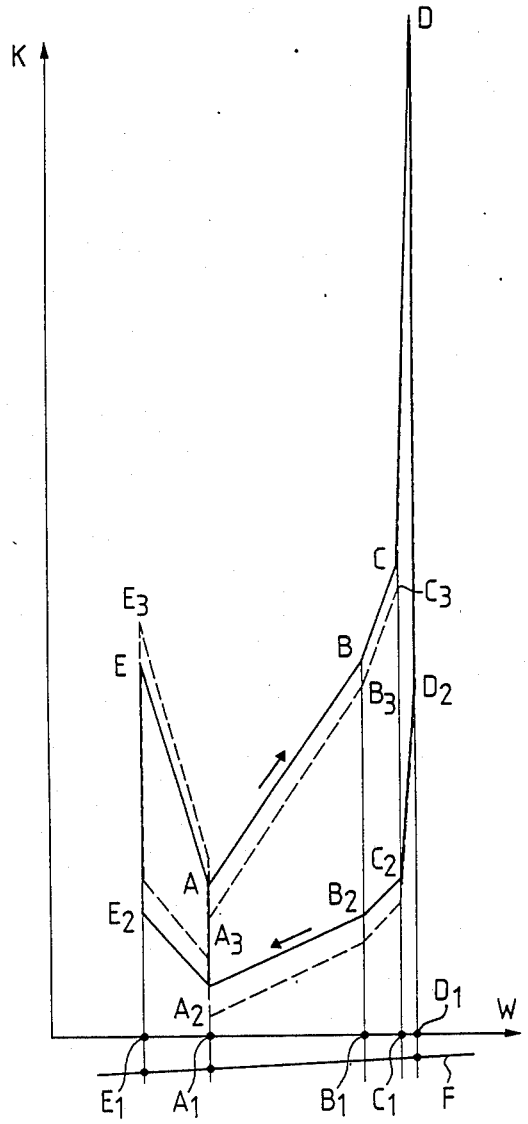
FIG. 2 A working diagram of the countercoil and recoil damper shown in FIG. 1.

Referring now to FIG. 2, as long as all the annular spring packs 32 through 35 can be compressed, the force K increases from value A to value B during weapon recoil along the longitudinal axis W from point A1 to point B1, as shown in FIG. 2, i.e., the spring characteristics graph is still relatively flat.

Subsequently, only annular spring packs 32, 33 and 35 can be compressed, and therefore the force will increase further during weapon recoil from point B1 to point C1 and will reach value C, which means that the characteristics graph is somewhat steeper. At this point C, sleeve 30 comes into contact with sleeve 27 and annular spring pack 32 cannot be compressed any further. If the weapon recoils further, such as in case of a malfunction, only annular spring packs 33 and 35, which are parallel to each other, are compressed, and therefore the force will further increase when the weapon recoils from point C1 to point D1 to attain value D. Further recoil is no longer possible because annular spring packs 33 and 35 are now fully compressed or because the weapon has reached a stop.

Due to friction, some of the energy is consumed in the annular spring packs and therefore the force drops to value D2. During weapon countercoil from point D1 to point C1, the force drops steeply at first to value C2, as only annular spring packs 33 and 35 are released. When the weapon is displaced from point C1 to point B1, the force drops less steeply to value B2, as in addition to annular spring packs 33 and 35, annular spring pack 32 is also released, and during the displacment of the weapon from point B1 to point A1 the force drops yet less steeply to value A2 because now all the annular spring packs 32, 33, 34 and 35 are released.

Due to the fact that the weapon still has kinetic energy when it reaches its starting point at A1, it will continue to move forward as far as point E1. During this countercoil, shoulder 29 of housing 10 is pushed against sleeve 27 and shoulder 38 of sleeve 19 of housing 10 is pushed against sleeve 31. Thus, both sleeves 27 and 31 move forward simultaneously over an equal distance and annular spring pack 32 is not compressed, but only annular spring pack 34 is compressed. Therefore the force increases relatively steeply from value A to value E. As soon as the weapon reaches the forwardmost point E this force drops to value E2 without displacement of the weapon, as energy is lost again due to friction. Subsequently the weapon reaches its starting point A1, and at the same time the energy drops to value A2.

Until now, this description has only taken into account the forces of annular spring packs 32 through 35 and not the force of coil spring 24. Spring 24 is released during weapon recoil, in contrast to annular spring packs 32 through 35, which are compressed. The force of coil spring 24 counteracts the force of annular spring packs 32 through 35. Therefore, as shown on FIG. 2, the force of coil spring 24 must be subtracted from the force of annular spring packs 32 through 35. The result is represented by the broken lines below the solid lines connecting points A, B, C, D, D2, C2, B2, and A2.

During weapon countercoil beyond its starting point, annular spring pack 34 and coil spring 24 are compressed at the same time, and therefore the force of annular spring pack 34 and that of coil spring 24 are applied in the same direction, so that, as FIG. 2 shows, the force of coil spring 24 must be added to the force of annular spring pack 34. This is represented by the broken lines above the solid lines connecting points A, E, E2, and A2.

FIG. 2 shows that during countercoil the forces decrease until they are one third of the forces during recoil. In other words, forces A2, B2, C2 and D2 are approximately one third of the forces A, B, C and D, whereas this ratio is only one fourth when the force of coil spring 24 is subtracted.

Hysteresis is thus relatively greater without increased friction, i.e., without any changes in the annular spring packs.

Finally, it should be noted that it is possible to influence the characteristics graph of annular spring back 32 by means of spacer 39.

Preferably, compression distance a (see FIG. 1) of the first annular spring pack 34 will be shorter than the compression distance b of the second annular spring pack 32. In addition, the characteristics graph F of the coil spring 24 is relatively flat as shown at the bottom of FIG. 2.

While the invention has been described by reference to a preferred embodiment, this was for purposes of illustration only and should not be construed to limit the spirit or the scope of the invention.

We claim:

1. A countercoil and recoil damper for an automatic firearm having a fixed gun mount and weapon housing slidingly supported by said gun mount, comprising first and second annular spring means connected to said weapon housing, said first and second annular spring means being arranged in a series, said first and second annular spring means cooperating to dampen the recoil energy of said firearm after said firearm has been fired, said first annular spring means also acting to dampen the countercoil energy of said firearm, said first and second annular spring means having steeper spring characteristics during compression than during release, and a third spring means connected to said weapon housing, said third spring means being pretensioned prior to firing of said firearm and being released from said pretensioning during recoil of said firearm, said third spring means having a forward end and a rear end, said forward end applying force to said gun mount in the direction of fire and said rear end applying force to said weapon housing during the whole recoil and during the whole countercoil of said firearm, wherein said third spring means acts in a direction opposite to said first and second annular spring means during the whole recoil and the countercoil of said firearm, said third spring means cooperating with said first annular spring means to dampen the whole countercoil energy of said firearm.

2. The countercoil and recoil damper of claim 1, wherein said forward end of said third spring means bears against a first flange of said gun mount and said rear end of said third spring means bears against a first shoulder of said weapon during the whole recoil and the whole countercoil of said firearm.

3. The countercoil and recoil damper of claim 1 wherein said first annular spring means has a forward end and a rear end, said forward end of said first annular spring means applying force to said weapon housing and said rear end of said first annular spring means applying force to said gun mount during recoil of said firearm, said forward end of said first annular spring means applying force to said gun mount and said rear end of said first annular spring means applying force to said weapon housing during countercoil of said firearm.

4. The countercoil and recoil damper of claim 3 wherein said forward end of said first annular spring means bears against a first movable sleeve of said weapon housing via a ring, and said rear end of said first annular spring means bears against a second shoulder of said gun mount via said second annular spring means and second and third movable sleeves during recoil of said firearm.

5. The countercoil and recoil damper of claim 4 wherein said forward end of said first annular spring means bears against a second flange of said gun mount via said ring and said rear end of said first annular spring means bears against a third shoulder of said weapon housing via a fourth movable sleeve during countercoil of said firearm.

6. The countercoil and recoil damper of claim 5 wherein said second annular spring means has a forward end and a rear end, said forward and rear ends of said second annular spring means each applying force to said weapon housing during countercoil of said firearm, whereby said second annular spring means is not subjected to compression during countercoil.

7. The countercoil and recoil damper of claim 6 wherein said rear end of said second annular spring means bears upon a fourth shoulder of said weapon housing via said second movable sleeve, and said forward end of said second annular spring means bears upon said third shoulder of said weapon housing via said third movable sleeve.

8. The countercoil and recoil damper of claim 7 further comprising a fourth annular spring means in series with and between said first and second annular spring means, said fourth annular spring means being separated from said second annular spring means by a fourth movable sleeve.

9. The countercoil and recoil damper of claim 8 wherein said first annular spring means has a compression stroke a defined by the length of the first movable sleeve, and said second annular spring means has a compression stroke b defined by the length of the second and fourth movable sleeves.

10. The countercoil and recoil damper of claim 8 further comprising a fifth annular spring means, said fifth annular spring means being concentric with said fourth annular spring means.

11. The countercoil and recoil damper of claim 9 wherein said compression stroke a of said first annular spring means is shorter than said compression stroke b of said second annular spring means.

12. The countercoil and recoil damper of claim 1 wherein said third spring means is a coil spring, said coil spring having a substantially flat characteristics graph.

13. A countercoil and recoil damper for an automatic firearm having a fixed gun mount and a weapon housing slidingly supported by said gun mount, comprising first and second annular spring means connected to said weapon housing, said first and second annular spring means being arranged in a series, said first and second annular spring means cooperating to dampen the recoil energy of said firearm after said firearm has been fired, said first annular spring means also acting to dampen the countercoil energy of said firearm, said first and second annular spring means each having front and rear ends, said first and second annular spring means having steeper spring characteristics during compression than release, a third spring means connectted to said weapon housing and acting in a direction opposite that of said first and second annular spring means during the whole recoil and countercoil of said firearm, said third spring being pretensioned prior to firing of said firearm and being released from said pretensioning during recoil of said firearm, said third spring means cooperating with said first annular spring means to dampen the countercoil energy of said firearm, said third spring means having a forward end and a rear end, said forward end bearing against a first flange of said gun mount in the direction of fire and said rear end of said third spring means applying force against a first shoulder of said weapon housing during recoil and countercoil of said firearm, said forward end of said first annular spring means bearing against a first movable sleeve of said weapon housing via a ring during recoil of said firearm, said forward end of said first annular spring means bearing against a second flange of said gun mount via said ring during countercoil of said firearm, said rear end of said first annular spring means bearing against a second shoulder via said second annular spring means and second and third movable sleeves during recoil of said firearm, said rear end of said first annular spring means bearing against a third shoulder of said weapon housing via a fourth movable sleeve during countercoil of said firearm, said forward end of said second annular spring means bearing upon said third shoulder via said third movable sleeve, said rear end of said second annular spring means bearing upon a fourth shoulder of said weapon via said second movable sleeve, said second annular spring means not being subjected to compression during countercoil, and a fourth annular spring means connected in series with and between said first and second annular spring means, said fourth annular spring means being separated from said second annular spring means by said third movable sleeve.

14. The countercoil and recoil damper of claim 13 wherein said first annular spring means has a compression stroke a defined by the length of the first movable sleeve, and said second annular spring means has a compression stroke b defined by the length of the second and fourth movable sleeves.

15. The countercoil and recoil damper of claim 13 further comprising a fifth annular spring means, said fifth annular spring means being concentric with said fourth annular spring means.

16. The countercoil and recoil damper of claim 14 wherein said compression stroke a of said first annular spring means is shorter than said compression stroke b of said second annular spring means.

17. The countercoil and recoil damper of claim 13 wherein said third spring means is a coil spring, said coil spring having a substantially flat characteristics graph.

18. A countercoil and recoil damper for an automatic firearm having a fixed gun mount and weapon housing slidingly supported by said gun mount, comprising first and second annular spring means connected to said weapon housing, said first and second annular spring means being arranged in a series, said first and second annular spring means cooperating to dampen the recoil energy of said firearm after said firearm has been fired, said first annular spring means also acting to dampen the countercoil energy of said firearm, said first and second annular spring means having steeper spring characteristics during compression than during release, and a third spring means connected to said weapon housing, said third spring means being in line with said first and second annular spring means and being pretensioned prior to firing of said firearm, said third spring means being released from said pretensioning during recoil of said firearm, said third spring means having a forward end and a rear end, said forward end applying force to said gun mount in the direction of fire and said rear end applying force to said weapon housing during the whole recoil and during the whole countercoil of said firearm, wherein said third spring means acts in a direction opposite to said first and second annular spring means during the whole recoil and the countercoil of said firearm, said third spring means cooperating with said first annular spring means to dampen the whole countercoil energy of said firearm.

* * * * *